US009637930B2

(12) United States Patent
Grudzien et al.

(10) Patent No.: US 9,637,930 B2
(45) Date of Patent: May 2, 2017

(54) REMOVABLE REVERSIBLE HANDRAIL ASSISTANCE DEVICE

(71) Applicants: Michael Joseph Grudzien, Erie, PA (US); Ray Polanski, Erie, PA (US)

(72) Inventors: Michael Joseph Grudzien, Erie, PA (US); Ray Polanski, Erie, PA (US)

( * ) Notice: Subject to any disclaimer, the term of this patent is extended or adjusted under 35 U.S.C. 154(b) by 342 days.

(21) Appl. No.: 14/511,586

(22) Filed: Oct. 10, 2014

(65) Prior Publication Data

US 2015/0021536 A1 Jan. 22, 2015

Related U.S. Application Data

(63) Continuation-in-part of application No. 13/771,481, filed on Feb. 20, 2013, now Pat. No. 8,925,155, which is a continuation-in-part of application No. 29/414,565, filed on May 11, 2012, now abandoned.

(51) Int. Cl.
*E04F 11/18* (2006.01)

(52) U.S. Cl.
CPC ..... *E04F 11/1808* (2013.01); *E04F 11/1804* (2013.01); *E04F 11/1863* (2013.01); *Y10T 16/44* (2015.01); *Y10T 16/469* (2015.01); *Y10T 16/4713* (2015.01); *Y10T 16/498* (2015.01)

(58) Field of Classification Search
CPC .. B60N 3/023; B60N 3/026; A61H 2003/001; A47K 17/022; E04F 11/18; E04F 11/1863; E04F 11/1802; E04F 11/1804
See application file for complete search history.

(56) References Cited

U.S. PATENT DOCUMENTS

| | | | | |
|---|---|---|---|---|
| 1,389,477 | A | 8/1921 | Beeman | |
| 2,238,513 | A | 4/1941 | Ward | |
| 2,586,986 | A * | 2/1952 | Orrison | B60N 3/026 105/354 |
| 3,121,907 | A | 2/1964 | Stebbins | |
| 4,048,471 | A | 9/1977 | Ours | |
| D286,015 | S | 10/1986 | Johnson | |
| 4,626,016 | A | 12/1986 | Bergsten | |
| 4,686,742 | A | 8/1987 | Arnold | |
| D295,717 | S | 5/1988 | Driscoll | |
| 4,817,239 | A | 4/1989 | Campbell et al. | |
| 4,926,965 | A | 5/1990 | Fox | |
| 5,233,731 | A * | 8/1993 | Phillips | B60R 13/0206 24/297 |

(Continued)

FOREIGN PATENT DOCUMENTS

| | | | |
|---|---|---|---|
| GB | 2459791 | A | 11/2009 |
| JP | 10314247 | A | 12/1998 |

(Continued)

*Primary Examiner* — Michael P Ferguson
(74) *Attorney, Agent, or Firm* — Knox Patents; Kenneth C. Spafford

(57) ABSTRACT

A removable handrail assistance device includes a bracket and a handle extension. The bracket may be affixed to a wall or other essentially immobile structure. The handle may be easily inserted into, or removed from, the bracket. The inserted handle extension is capable of supporting a user who holds onto the handle for support while, for example, climbing up or down one or more stairs. The bracket may be reversible, thereby allowing the handle to point in an opposite direction when inserted.

12 Claims, 15 Drawing Sheets

(56) References Cited

U.S. PATENT DOCUMENTS

| | | | | |
|---|---|---|---|---|
| 5,248,067 | A * | 9/1993 | Garcia | A47K 5/00 222/181.2 |
| 5,337,430 | A | 8/1994 | Schlein | |
| 5,658,026 | A | 8/1997 | Nigro et al. | |
| D384,569 | S | 10/1997 | Simon et al. | |
| D407,299 | S | 3/1999 | McCreary | |
| 6,163,894 | A | 12/2000 | Simonds | |
| 6,189,183 | B1 | 2/2001 | Hartselle | |
| 6,276,027 | B1 | 8/2001 | Hanna | |
| 6,340,189 | B1 | 1/2002 | Pordy | |
| 6,708,887 | B1 | 3/2004 | Garrett et al. | |
| 6,799,353 | B1 | 10/2004 | Stewart | |
| D511,083 | S | 11/2005 | Gurzenda et al. | |
| 6,961,972 | B2 | 11/2005 | Pendell | |
| 6,986,177 | B2 | 1/2006 | Thaxton | |
| 7,039,971 | B2 | 5/2006 | Sebastien | |
| D539,113 | S | 3/2007 | Fulkerson | |
| D569,222 | S | 5/2008 | Lee | |
| 7,624,966 | B2 | 12/2009 | Dando et al. | |
| 7,744,141 | B2 | 6/2010 | Saionji et al. | |
| 7,870,695 | B2 * | 1/2011 | Manson | E04F 11/1863 198/335 |
| D637,885 | S | 5/2011 | Buck | |
| D658,029 | S | 4/2012 | Fulkerson et al. | |
| 8,322,782 | B2 * | 12/2012 | Shallcross | B60R 16/0215 24/297 |
| 2006/0230540 | A1 | 10/2006 | Whelan | |
| 2012/0133168 | A1 | 5/2012 | Ardigo | |
| 2013/0326845 | A1 | 12/2013 | Hinkle | |

FOREIGN PATENT DOCUMENTS

| | | | |
|---|---|---|---|
| JP | 2003089491 | A | 3/2003 |
| JP | 2009191571 | A | 8/2009 |
| JP | 2010053581 | A | 3/2010 |

* cited by examiner

REMOVABLE REVERSIBLE HANDRAIL ASSISTANCE DEVICE

CROSS-REFERENCE TO RELATED APPLICATIONS

This application is a continuation-in-part of utility application Ser. No. 13/771,481, filed Feb. 20, 2013, which is a continuation-in-part of design patent application Ser. No. 29/414,565, filed May 11, 2012.

FIELD OF THE INVENTION

This disclosure is directed to a device and assembly that is a removable handrail extension, to be located, for example, at the top or bottom of stairs.

The device allows the user to grip the stable handle portion of the device while climbing up or down a step, or in other situations where a steady handle might be useful, e.g., getting out of bed, using the lavatory, or walking across a slippery surface.

BACKGROUND AND SUMMARY OF THE INVENTION

Persons who have difficulty climbing up or going down stairs will often need the assistance of a handrail. However, a stair handrail will ordinarily only extend as far as the last step before a landing or floor. Handrails usually cannot extend farther, either for aesthetic reasons, or for safety reasons, e.g., an extra-long handrail might be a dangerous protrusion.

Thus, a person who needs a handrail for every stair step will often have difficulty taking the first or last step on a set of stairs due to the lack of any rail or other sturdy object to hold onto.

Thus, there exists a need for a removable handrail that can be easily inserted and removed from a relatively unobtrusive bracket, where the handrail is positioned, for example, to be used for additional threshold support at the first or last step on a set of stairs.

In the displayed embodiments, the device comprises a bracket and a handle. In these embodiments, the proximal, connector, and distal portions and sides of the handle are positioned substantially at right angles to each other. Components of the brackets are likewise at substantially right angles to one another and designed to receive the handle at right angles. As a result, when the handle is inserted into the bracket the handle is immobilized in virtually all directions in which a user might exert a force vector upon the handle during use. The handle can be easily removed because an inserted handle is not prevented from being lifted directly upward, and directly upward is the one direction in which a user is extremely unlikely to push during use.

Directional terms such as "right", "left", "top" and "bottom" in this disclosure and in the claims are only used to explain the relative positions of elements and parts, and are not always absolute. For example, right/left and top/bottom (e.g., for the handle) might be reversed in this disclosure if the bracket were designed or positioned such that the terminal end of the handle were to point right rather than left.

Various changes, alternatives and modifications will become apparent to one of ordinary skill in the art following a reading of this specification and a review of the drawings. It is intended that any such changes, alternatives and modifications as fall within the scope of the appended claims be considered part of the present invention.

DETAILED DESCRIPTION

Figure 1A:
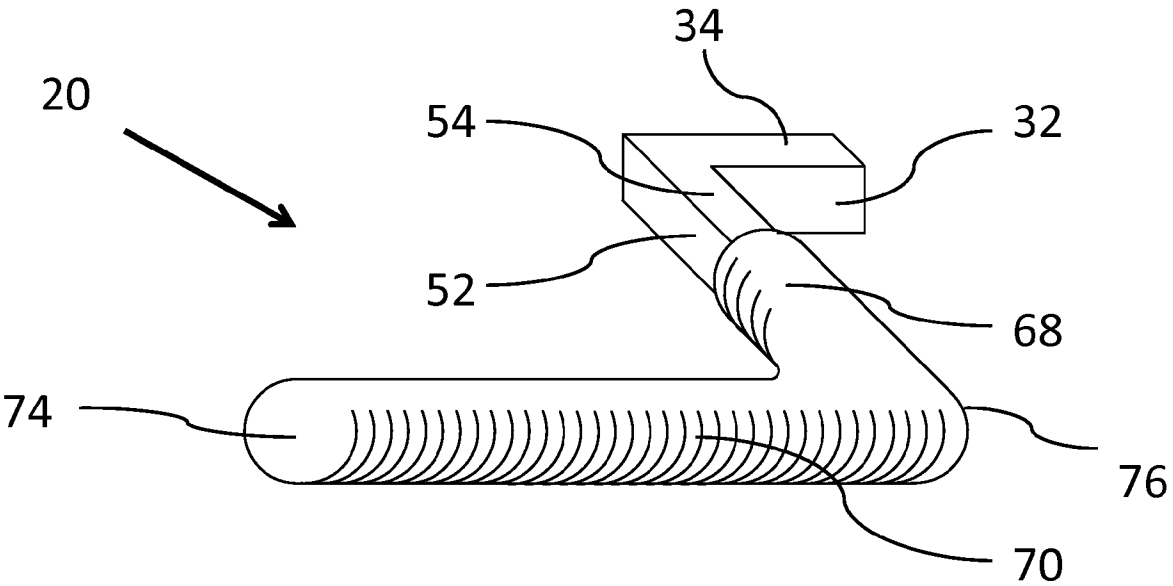
FIG. 1A is a front perspective view of the handle portion of a first embodiment.
Figure 1B:
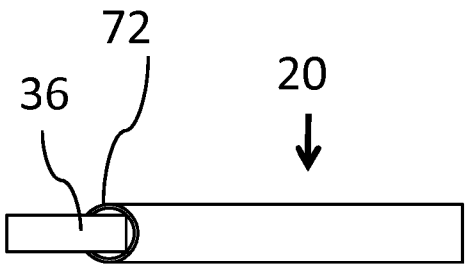
FIG. 1B is a rear view of the handle of FIG. 1A.
Figure 1C:
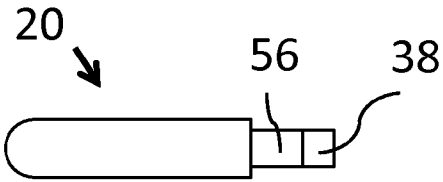
FIG. 1C is a right side view of the handle of FIG. 1A.
Figure 1D:
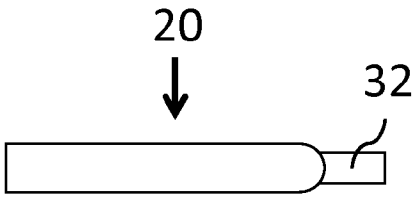
FIG. 1D is a front view of the handle of FIG. 1A.

Referring first to FIGS. 1A, 1B, 1C, 1D, 1E, and 1F, the first displayed embodiment 10 includes a handle 20. The handle 20 can be made of a strong material such as steel. The distal gripping portion 70 of the handle may be cylindrical and may include a wrap or cover 72 of foam, for example.

Handle proximal top side 34 and proximal bottom side 40 are adjacent and perpendicular to proximal front side 32 and proximal back side 36. Handle proximal end side 38 is adjacent and perpendicular to proximal top, bottom, front, and back sides 34, 40, 32, 36.

Handle connector left side 52 is adjacent and perpendicular to handle proximal back side 36. Connector right side 56 is adjacent to perpendicular to proximal front side 32.

Figure 1F:
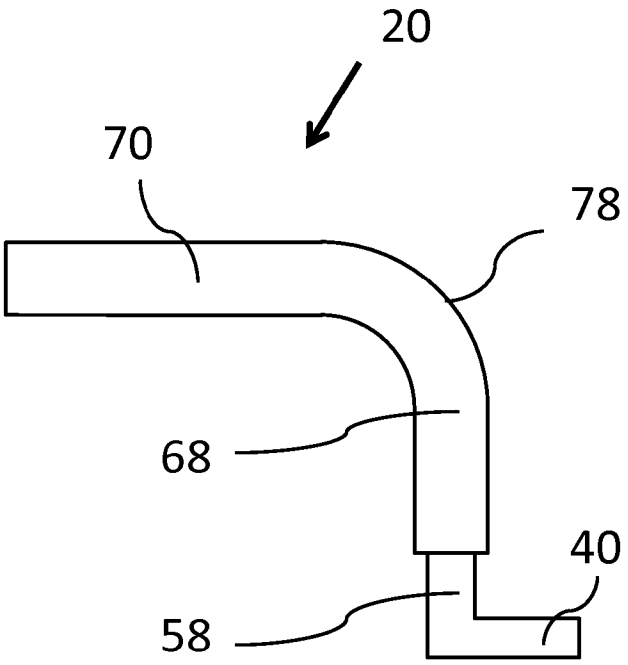
FIG. 1F is a bottom view of a variation of the handle of FIG. 1A.
Figure 1E:
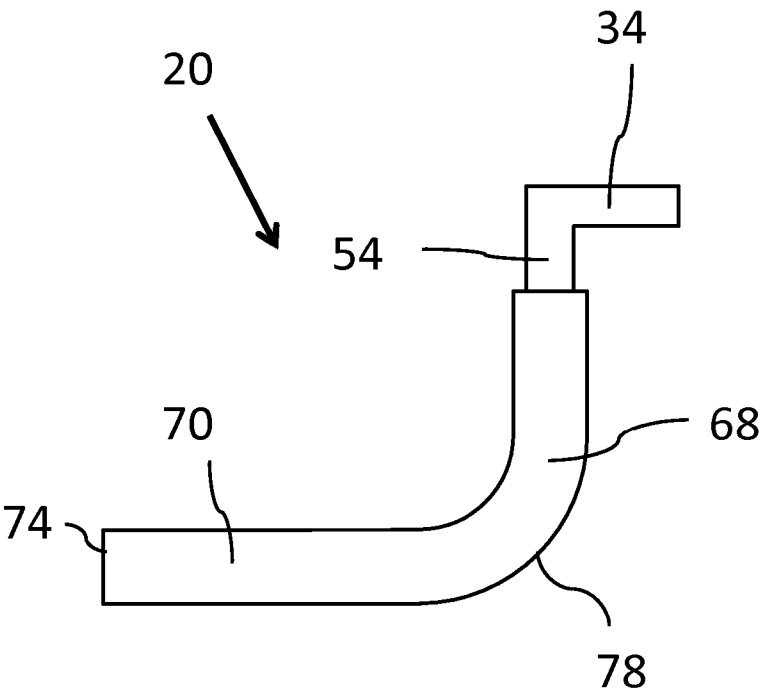
FIG. 1E is a top view of a variation of the handle of FIG. 1A.

The distal gripping portion 70 may be parallel to the proximal top, bottom, front, and back sides 34, 40, 32, 36. The gripping portion 70 may connect to the remainder of the handle at a relative sharp angle as shown at 76 in FIG. 1A, for example, or may connect at a gentle curve 78 as shown in FIGS. 1E and 1F.

Referring now to FIGS. 2A, 2B, 2C, 2D, 2E, and 2F, the displayed first embodiment also includes a bracket 120. In the displayed first embodiment, the bracket 120 has holes 128 for using screws or other fasteners to affix the bracket 120 to wall studs, for example.

Figure 2A:
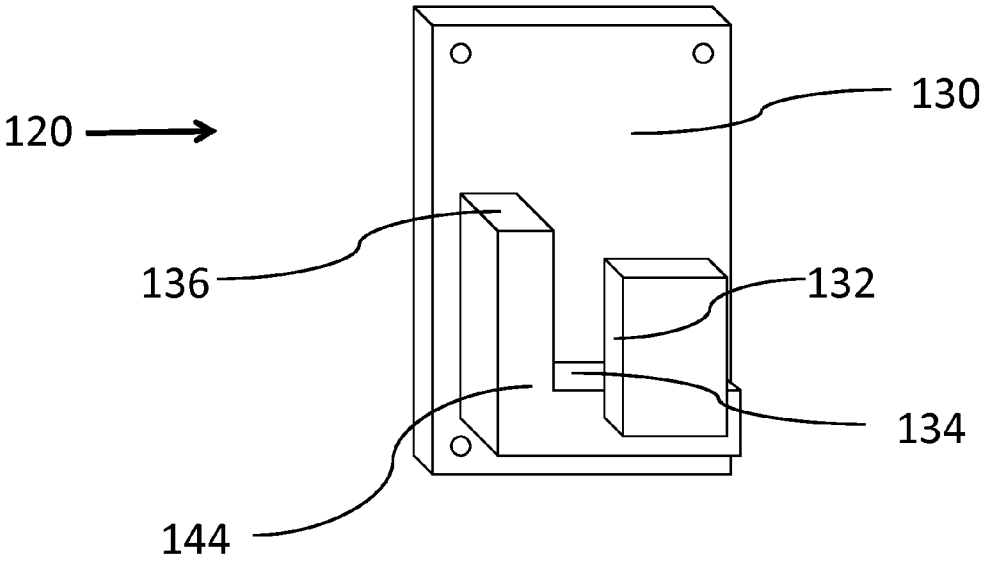
FIG. 2A is a front perspective view of the bracket portion of the first embodiment.
Figure 2B:
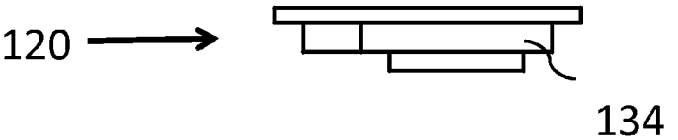
FIG. 2B is a top view of the bracket of FIG. 2A.
Figure 2C:
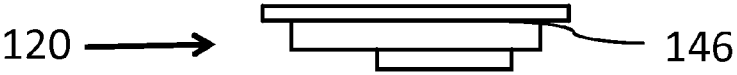
FIG. 2C is a bottom view of the bracket of FIG. 2A.
Figure 2D:
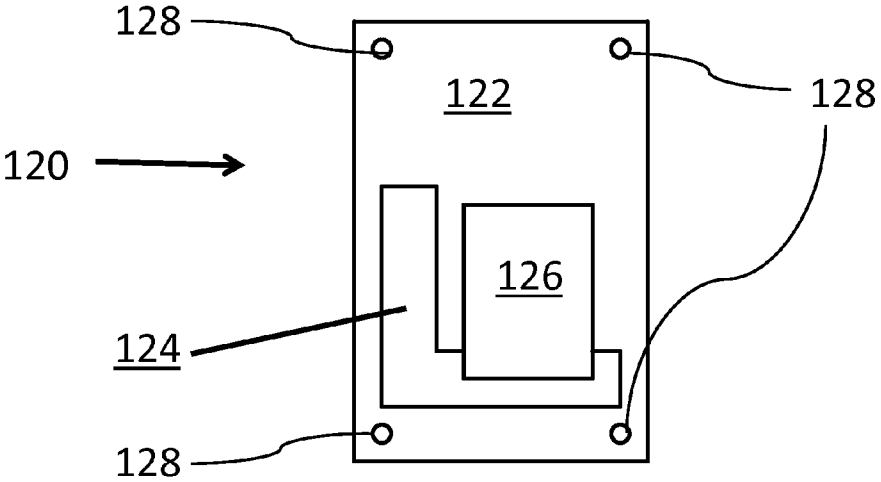
FIG. 2D is a front view of the bracket of FIG. 2A.
Figure 2F:
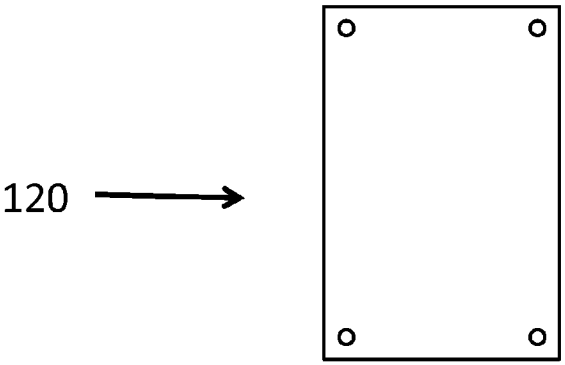
FIG. 2F is a rear view of the bracket of FIG. 2A.
Figure 2E:
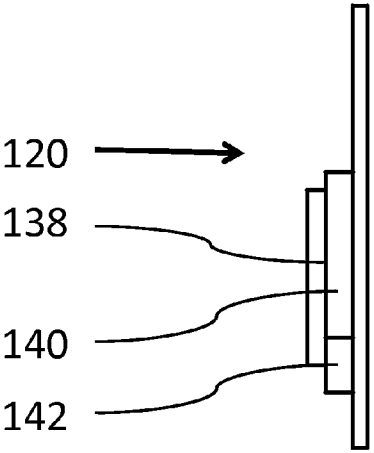
FIG. 2E is a right view of the bracket of FIG. 2A.

The bracket 120 might be cast as one piece, or can be made of three or more parts that are, for example, welded together. As shown in FIG. 2D, in this first embodiment the bracket 120 includes a face plate 122, a first extension 124, and a second extension 126. The back side (not shown) of the first extension 124 is affixed to the front side 130 of the face plate 122, and the back side 138 of the second extension is affixed to the front side 144 of the first extension 124.

Figure 3A:
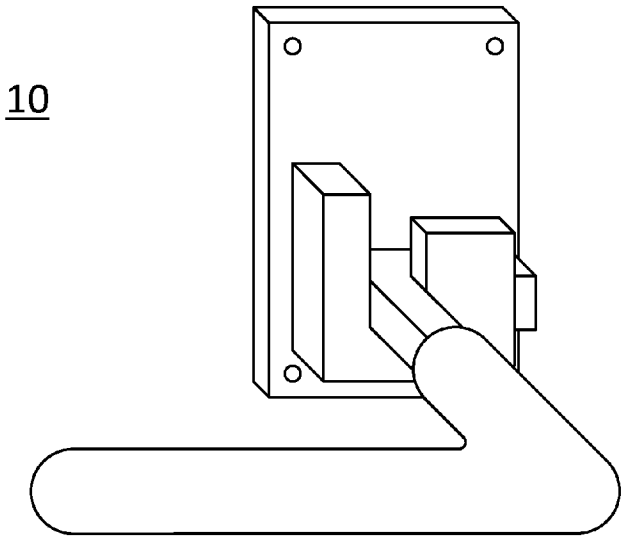
FIG. 3A is a front perspective view of the first embodiment.

First extension lower top side 134 is partially located between second extension back side 138 and face plate front side 130. First extension lower top side 134 is almost exactly the same width as handle proximal bottom side 40, such that the proximal front side 32 and proximal back side 40 of the handle 20 may fit snugly against second extension back side 138 and face plate front side 130, respectively, as shown in FIG. 3A.

First extension upper right side 140 is spaced apart from second extension left side 132 so that handle left connector side 52, right connector side 56, and bottom connector side 58 fit snugly against first extension upper right side 140, second extension left side 132 and first extension lower top side 134, respectively.

In any of the embodiments, some of the adjacent parts and sides in the handle (e.g., 20) and/or bracket (e.g., 120) might not be at perfect right angles or perfectly parallel but instead have slight deviations. For example, the handle might be designed such that when the proximal end of the handle is perfectly horizontal, the distal end terminates at a slight upward slope, so that when downward pressure is applied to the distal end during use the distal end will remain at least parallel with the floor. Or, to create the same effect, the first and second extension in the first embodiment might be rotated slightly clockwise on the face plate.

As another example of the elements not being at perfect right angles, the top of the second extension 126 might lean slightly outward from the face plate 122 and slope down in toward the face plate so that the proximal portion of the handle 20 can fit easily into the bracket 120 yet have the proximal front and back sides 32, 36 fit substantially snugly against the second extension back face 138 and face plate front side 130 once the handle has been completely inserted and the proximal bottom side 40 is resting against the first extension lower top side 134.

Figure 4A:
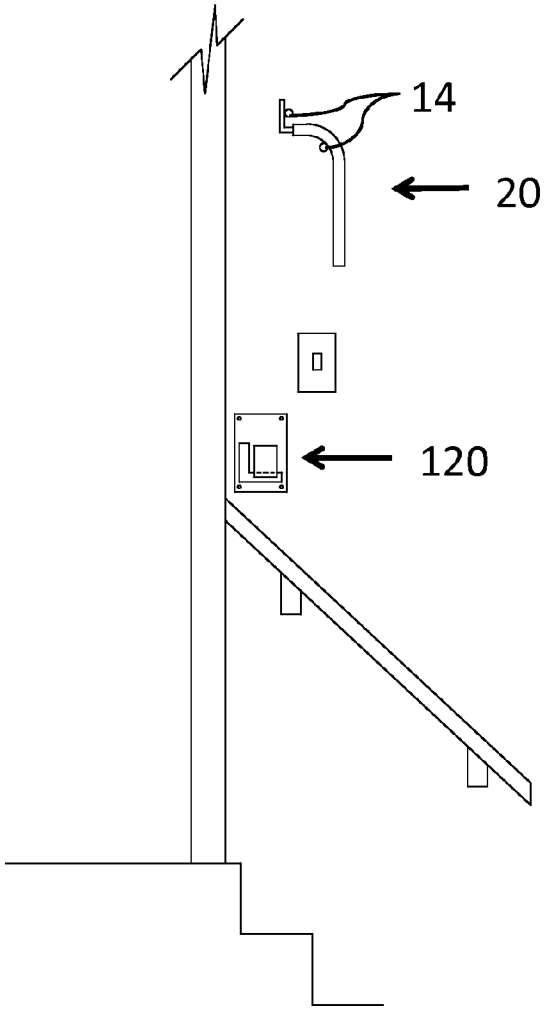
FIG. 4A shows a picture with the bracket of the first embodiment of the device affixed to a wall near the top of a set of stairs, and the handle portion of the embodiment of the device hanging on two screws on said wall.
Figure 4B:
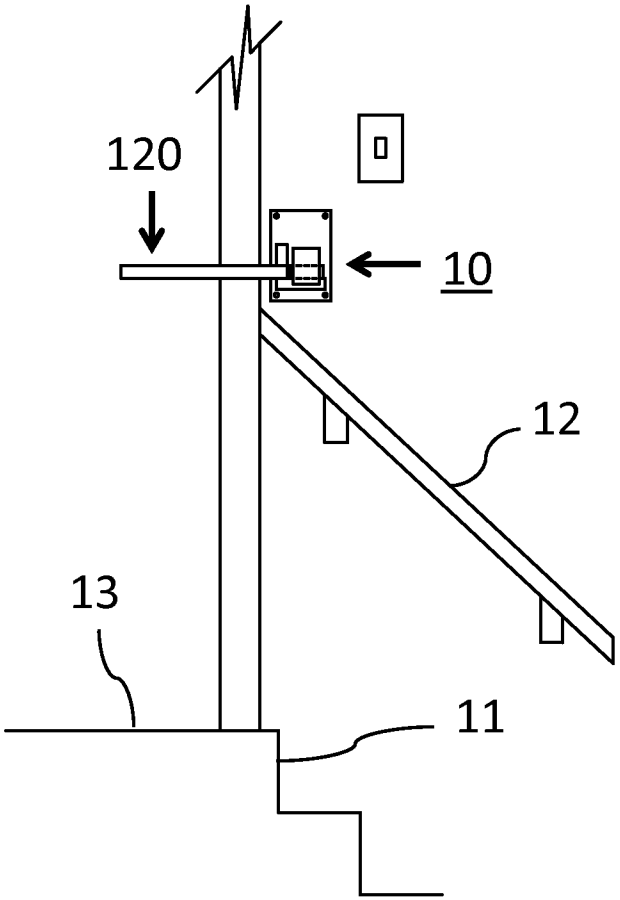
FIG. 4B shows the picture of 4A, with the handle portion of the embodiment of the invention inserted into the bracket portion of the first embodiment of the invention.
Figure 5A:
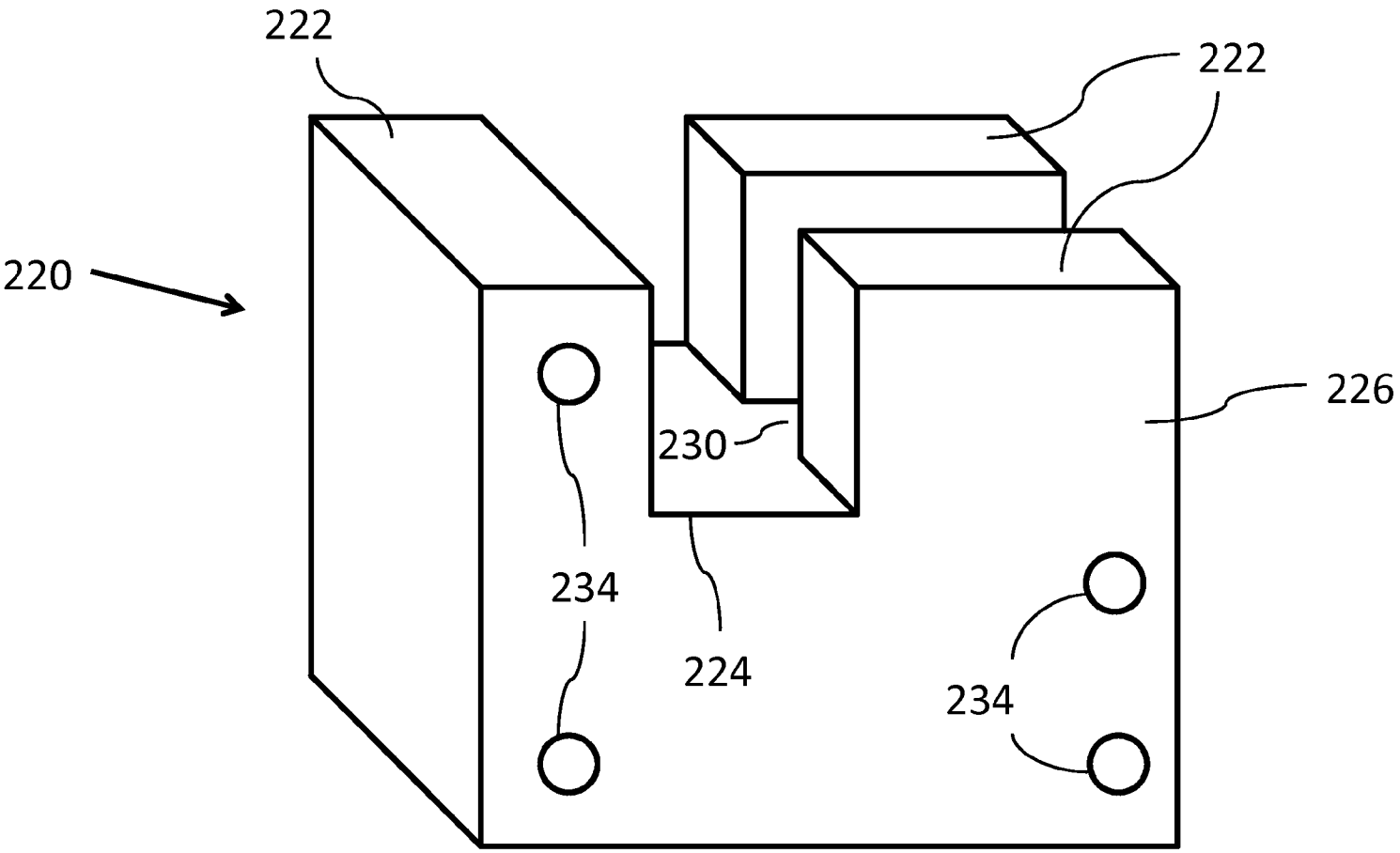
FIG. 5A shows a front perspective view of the bracket portion of a second embodiment.
Figure 5C:
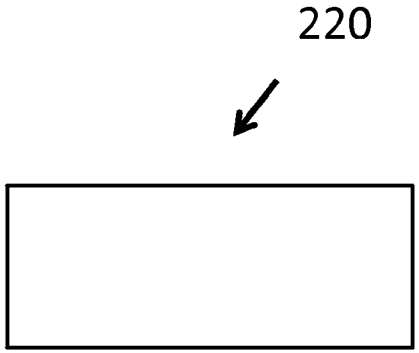
FIG. 5C shows a bottom view of the bracket of FIG. 5A.
Figure 5B:
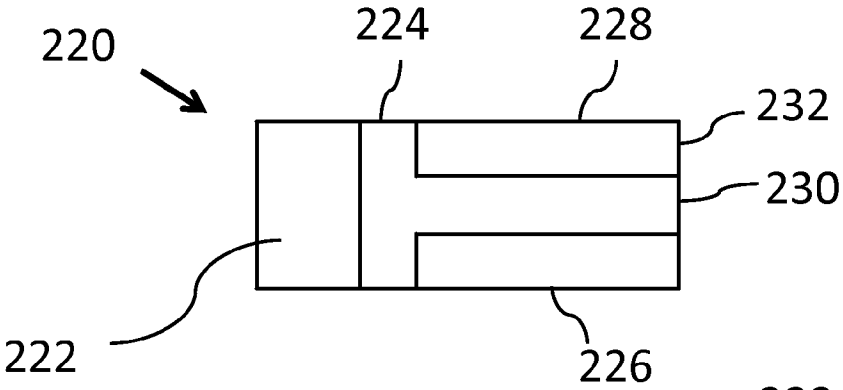
FIG. 5B shows a top view of the bracket of FIG. 5A.
Figure 5D:
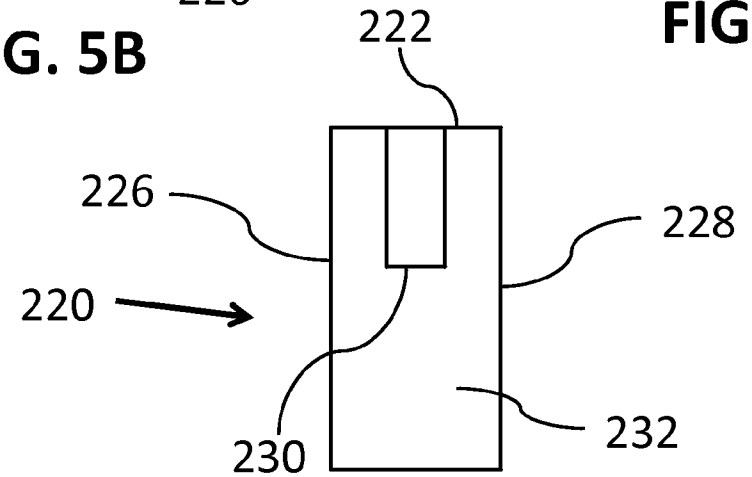
FIG. 5D shows a right face view of the bracket of FIG. 5A.
Figure 5F:
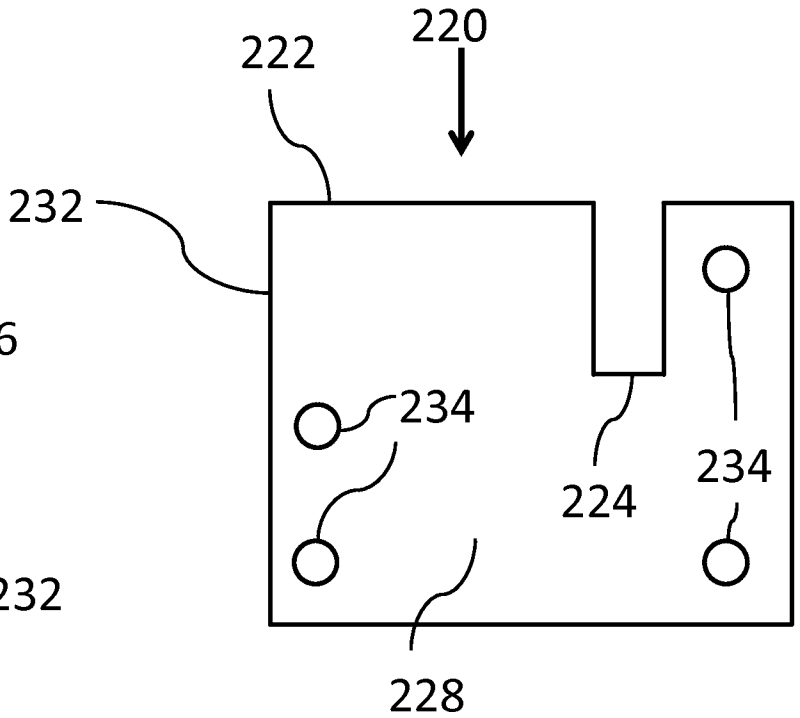
FIG. 5F shows back view of the bracket of FIG. 5A.
Figure 5E:
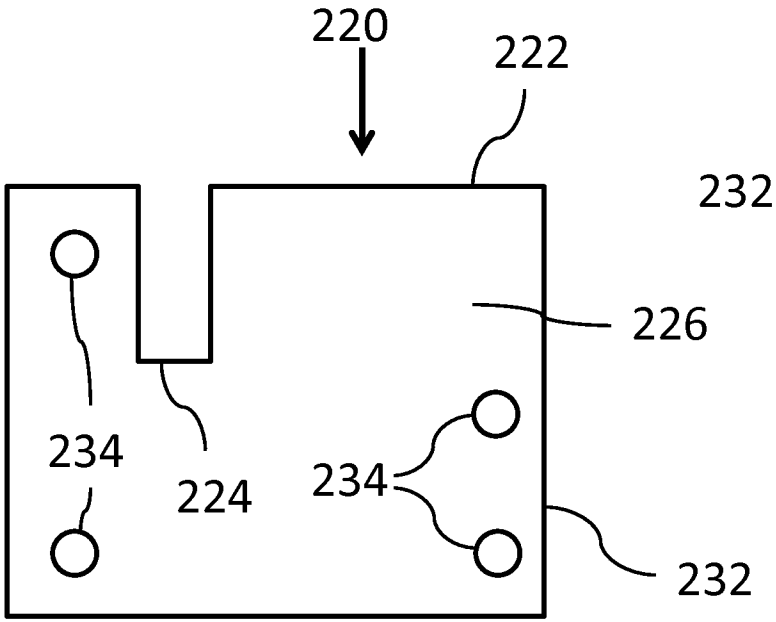
FIG. 5E shows a front view of the bracket of FIG. 5A.
Figure 6A:
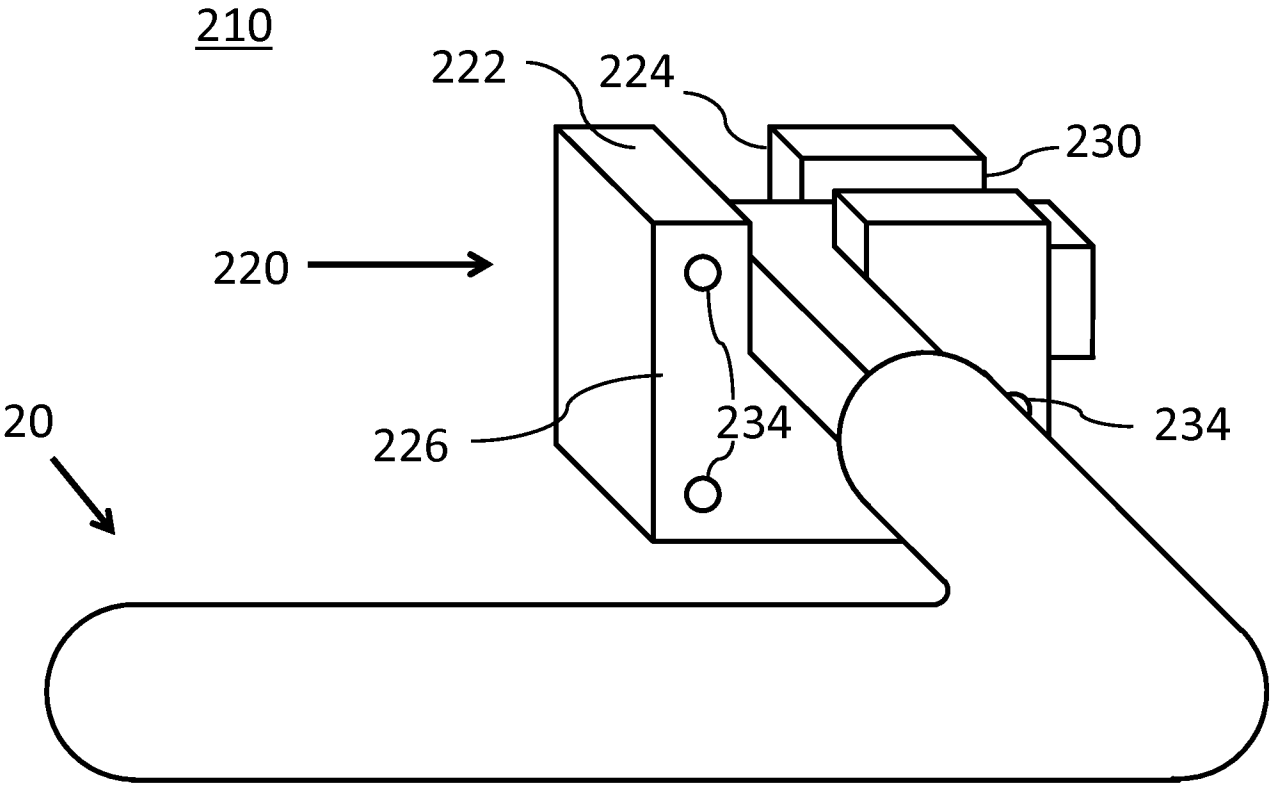
FIG. 6A shows a front perspective view of the second embodiment.
Figure 6C:
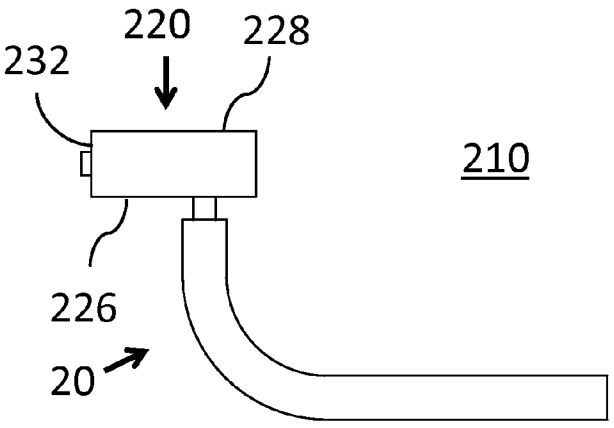
FIG. 6C shows a bottom view of the embodiment of FIG. 6A.
Figure 6B:
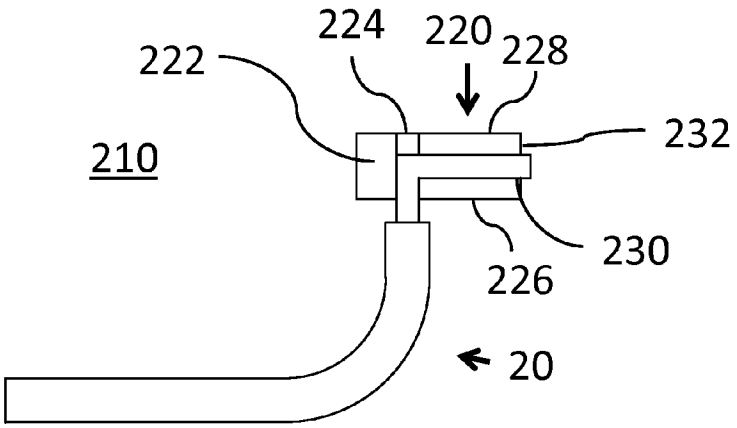
FIG. 6B shows a top view of the embodiment of FIG. 6A.
Figure 6D:
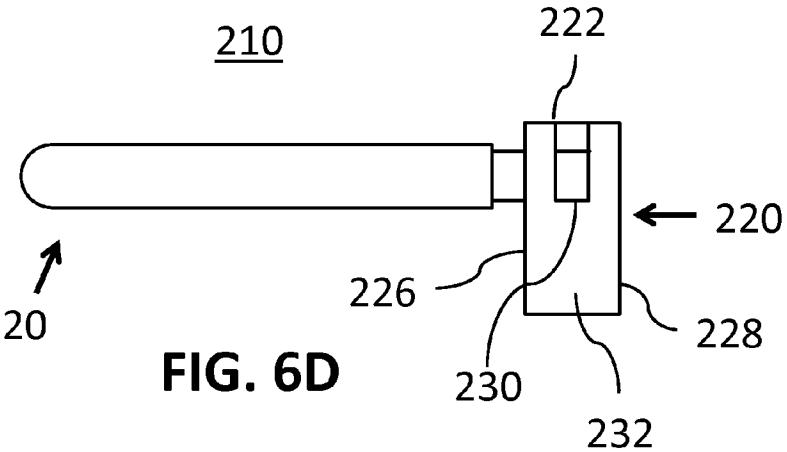
FIG. 6D shows a right view of the embodiment of FIG. 6A.
Figure 6F:
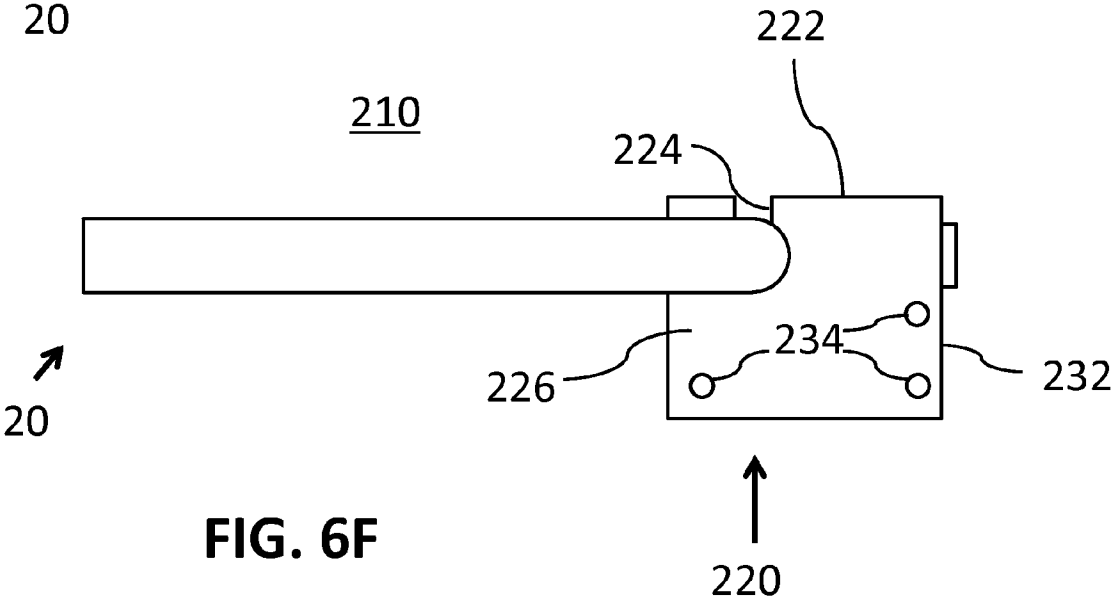
FIG. 6F shows a front view of the embodiment of FIG. 6A.
Figure 6E:
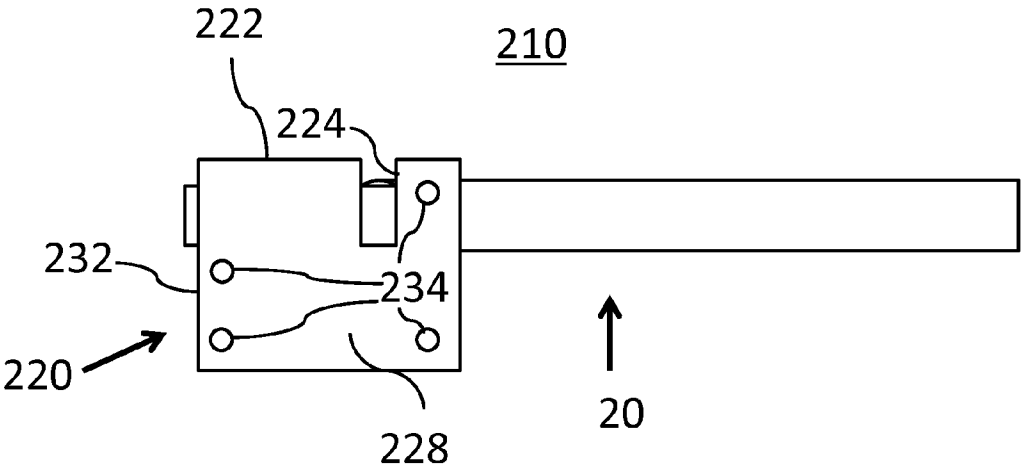
FIG. 6E shows a rear view of the embodiment of FIG. 6A.

FIGS. 3A and 4B display handle 20 inserted into bracket 120 for use. In this first embodiment, it is assumed that bracket 120 has been affixed to a wall, as shown in FIGS. 4A and 4B, by, for example, fastening the bracket 120 to wall studs with screws through the bracket apertures 128. Bracket 120 is positioned such that when handle 20 is inserted, handle grip 70 is located so that a person ascending the stairs 11, and who can no longer use the hand rail 12 at the last step(s), may then hold on to the handle 120 while stepping on to the landing 13, as shown in FIG. 4B. Of course, a similar device 10 could be positioned at the bottom of the stairs 11 such that the gripping portion 70 of the handle would likewise be an essential extension of the handrail, reachable and usable to a user descending the stairs onto the lower floor.

As shown in FIG. 4A, when handle 20 is not in use it may be removed from bracket 120 and be hung easily on two screws 14 or other wall protrusions. Handle 20 may also be carried with the user for use in another bracket 120.

Turning now to FIGS. 3A, 3B, 3C, 3D, 3E, and 3F, it is shown how handle 20 becomes safely immobilized once the proximal and connector portions are inserted downward into the bracket 120.

Figure 3B:
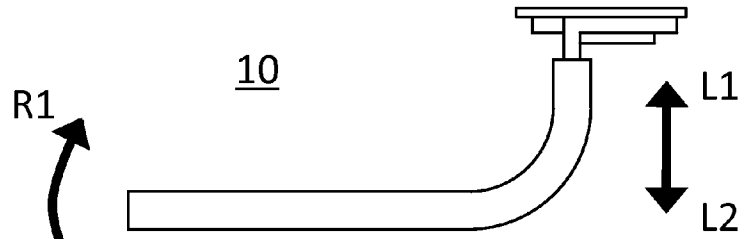
FIG. 3B is a top view of the embodiment of FIG. 3A.
Figure 3C:
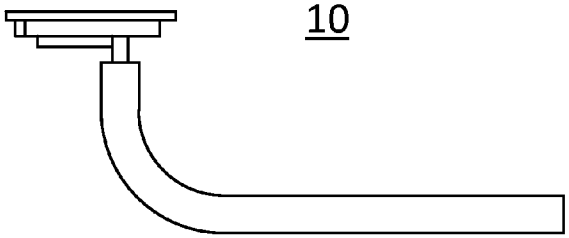
FIG. 3C is bottom view of the embodiment of FIG. 3A.

As shown in FIG. 3B, the inserted handle cannot be substantially rotated in the directions R1 and R2, and cannot be moved horizontally in the directions L1 and L2, because handle proximal front side 32 and back side 36 are positioned flat against second extension back side 138 and face plate front side 130, respectively.

Figure 3D:
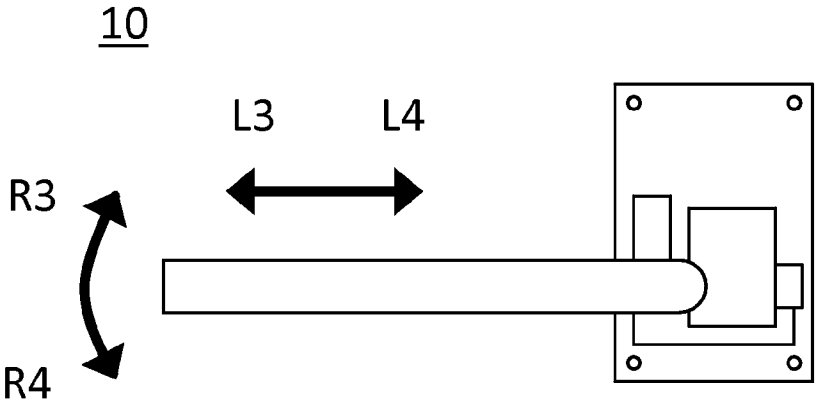
FIG. 3D is a front view of the embodiment of FIG. 3A.

As shown in FIG. 3D, the handle cannot be substantially rotated in the directions R3 and R4, and cannot be moved horizontally in the directions L3 and L4, because handle connector left side 52 and handle connector right side 56 are positioned flat against first extension upper right side 140 and second extension left side 132, respectively.

Figure 3E:
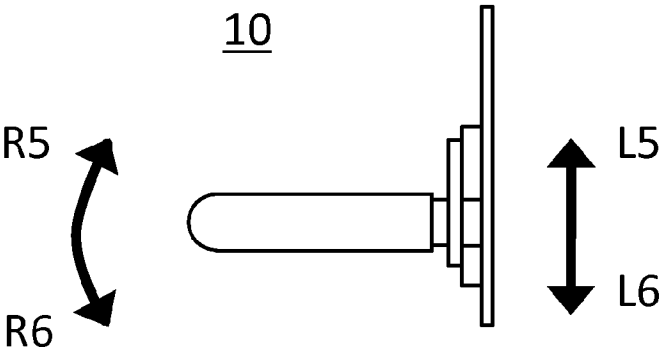
FIG. 3E is a right view of the embodiment of FIG. 3A.
Figure 3F:
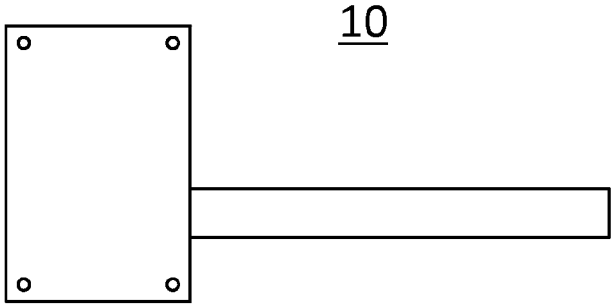
FIG. 3F is a rear view of the embodiment of FIG. 3A.

As shown in FIG. 3E, the handle cannot be substantially rotated in directions R5 and R6 because handle proximal front side 32 and back side 36 are positioned flat against second extension back side 138 and face plate front side 130, respectively.

The handle cannot be moved downward in the direction L6 because proximal bottom side 40 is resting flat against first extension lower top side 134.

Finally, the handle will not ordinarily move upward L5 because gravity is holding the handle in place. However, the handle may be removed from the bracket with relative ease by moving the handle straight upward in the direction of L5.

An easily reversible version of bracket 120 is embodied in cuboid-shaped bracket embodiment 220, as shown in FIGS. 5A-F, and as shown used in conjunction with handle 20 in FIGS. 6A-6F. Bracket 220 may be made from a single piece of material, for example, aluminum. Top face 222 includes a first channel 224 that extends from front face 226 to back face 228, and the first channel walls are at right angles to the first channel floor. Top face 222 also includes a second channel 230 that extends from right face 232 to at least first channel 224, and the second channel walls are at substantially right angles to the second channel floor. Second channel is equidistant from said front face 226 and said back face 228. In this embodiment, first and second channels 224, 230 are perpendicular to one another.

The width of first channel 224 is substantially equal to the width of the connector portion of handle 20, i.e., the distance between handle connector left side 52 and handle connector right side 56. The width of second channel 230 is substantially equal to the width of the distal portion of handle 20, i.e., the distance between handle proximal front side 32 and proximal back side 36. In this embodiment, the proximal end 38 of handle extends beyond bracket right face 232, but this is not required in all embodiments. In this embodiment, the depth of channels 224, 230 are substantially equal to, but greater than, the height of handle proximal and distal portions, i.e., the distance between proximal top side 34 and proximal bottom side 40, which in these embodiments is the same as the distance between connector top side 54 and connector bottom side 58.

Bracket 220 includes four holes 234 that extend from front face 226 to back face 228 and are generally parallel with first channel 224. The holes may be countersunk on both front face 226 and back face 228.

Figure 7B:
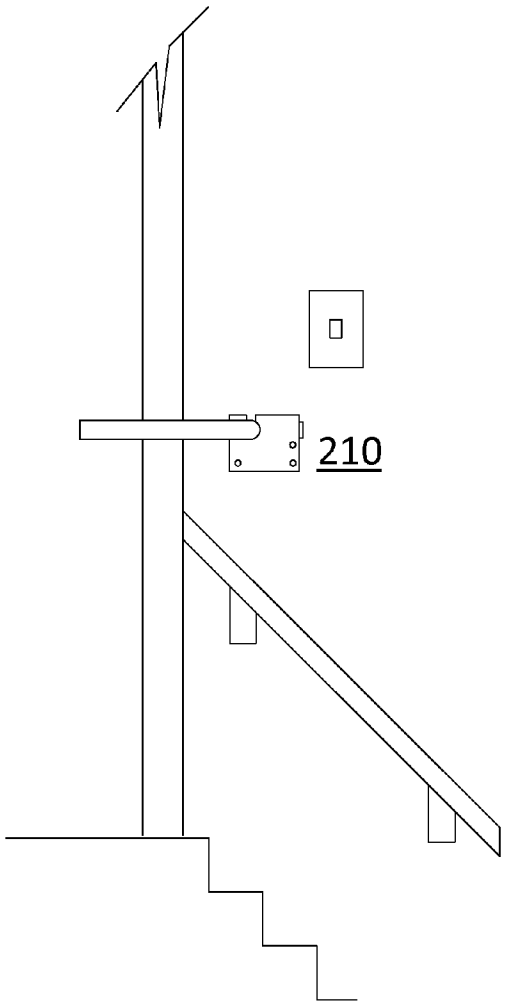
FIG. 7B shows the picture of 7A, with the handle portion inserted into the bracket portion of the second embodiment of the invention.
Figure 7A:
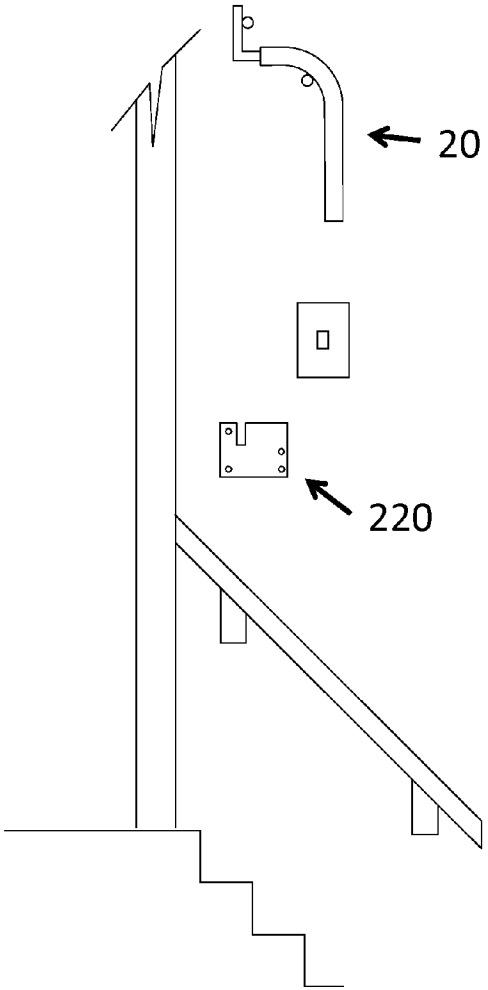
FIG. 7A shows a picture with the bracket of the second embodiment of the device affixed to a wall near the top of a set of stairs, and the handle portion hanging on two screws on said wall.

FIGS. 7A and 7B display the second embodiment 210 being used in the same way that first embodiment 10 is shown in FIGS. 4A and 4B. Second embodiment bracket 220 is reversible and may be fastened to a wall with the "back face" 228 facing outward, thereby causing the handle distal end 74 in this display to point rightward when handle 20 is properly inserted in bracket 220.

We claim:

1. A handrail assistance device, comprising:

(A) a handle, wherein said handle comprises:

(a) a proximal portion, wherein said proximal portion includes a proximal top side, a proximal bottom side, a proximal front side, and a proximal back side;

(b) a connector portion extending perpendicularly from a left end of said proximal front side, wherein said connector portion includes a connector top side, a connector left side, a connector right side, and a connector bottom side; and (c) a distal portion extending from an end of said connector portion opposite said proximal portion, and wherein said distal portion comprises a gripping surface;

wherein:

(i) said proximal top and bottom sides are adjacent and perpendicular to said proximal front and back sides;

(ii) said connector top and bottom sides are perpendicular and adjacent to said connector left and right sides;

(iii) said proximal front side is adjacent and perpendicular to said connector right side; and (iv) said proximal back side is adjacent and perpendicular to said connector left side;

(B) a cuboid-shaped bracket, wherein said bracket includes:

(a) a top face:

(b) a bottom face;

(c) a front face;

(d) a back face;

(e) a left face;

(f) a right face;

(g) a first channel with sides and a bottom, wherein the sides of said first channel are at substantially right angles to the bottom of said first channel; and (h) a second channel with sides and a bottom, wherein the sides of said second channel are at substantially right angles to the bottom of said second channel;

wherein:

(i) said first channel is recessed within said top face and longitudinally extends through said front face to said back face;

(ii) said second channel is recessed within said top face and longitudinally extends through said right face to at least said first channel but not to said left face;

(iii) said first and second channels are perpendicular to one another;

(iv) the distance between said handle's proximal front and back sides is substantially equal to a width of said second channel such that said proximal portion is received therein and extends through said right face; and (v) the distance between said handle's connector left and right sides is substantially equal to a with of said first channel such that said connector portion is received therein and extends through said front face.

2. The device of claim 1, wherein said second channel is equidistant from said front face and said back face.

3. The device of claim 1, wherein said bracket is made of aluminum.

4. The device of claim 1, wherein said bracket front face includes four holes of identical circumference that continue to said bracket back face.

5. The device of claim 1, wherein the depths of said first and second channels are identical.

6. The device of claim 5, wherein the distance between said proximal top and bottom sides is substantially equal to the depth of said second channel.

7. The device of claim 6, wherein the distance between said connector top and bottom sides is less than the depth of said first channel.

8. A handrail assistance device, comprising:

(A) a handle, wherein said handle includes a proximal portion, a connector portion extending perpendicularly from an end of the proximal portion, and a distal portion extending from an end of the connector portion opposite said proximal portion, and wherein said distal portion comprises a gripping surface;

(B) a bracket with a top face, opposing front and back faces, and opposing side faces, wherein said top face of said bracket includes a first channel and a second channel, and wherein said first channel is perpendicular to and connected to said second channel; and wherein:

(a) said first channel is recessed within said top face and longitudinally extends through said front face to said back face, and (b) said second channel is recessed within said top face and longitudinally extends through one of said side faces to at least said first channel but does not extend completely across said top face to the other said side face;

wherein:

(A) said first channel has a uniform width, and the width of said first channel is substantially equal to a width of said connector portion such that said connector portion is received therein and extends through said front face; and (B) said second channel has a uniform width, and the width of said second channel is substantially equal to a width of said proximal portion such that said proximal portion is received therein and extends through said one of said side faces.

9. The device of claim 8, wherein said first and second channels each have substantially uniform depths, and the depths of said first and second channels are substantially equal to a height of said proximal and connector portions.

10. The device of claim 9, wherein depths of said first and second channels are greater than the heights of said proximal and connector portions.

11. The device of claim 8, further comprising four holes that extend completely through said bracket and are parallel to said first channel.

12. The device of claim 11, wherein each of said four holes is countersunk on both ends.

* * * * *